United States Patent [19]

Gay

[11] 4,122,618

[45] Oct. 31, 1978

[54] SKYWRITING APPARATUS

[76] Inventor: Gerald A. Gay, 1900 Alden Rd., Orlando, Fla. 32803

[21] Appl. No.: 801,635

[22] Filed: May 31, 1977

[51] Int. Cl.[2] ..... G09F 19/00

[52] U.S. Cl. ..... 40/213; 239/171; 244/136

[58] Field of Search ..... 40/213; 244/136; 239/171; 252/359 A, 359 CG

[56] References Cited

U.S. PATENT DOCUMENTS

| | | | |
|---|---|---|---|
| 2,065,024 | 12/1936 | Remey | 40/213 |
| 2,308,060 | 1/1943 | Rochefort-Lucay | 40/213 |
| 3,089,271 | 5/1963 | Copeland | 40/213 |

*Primary Examiner*—John F. Pitrelli
*Assistant Examiner*—G. Lee Skillington
*Attorney, Agent, or Firm*—Duckworth, Hobby, Allen & Pettis

[57] ABSTRACT

A skywriting apparatus produces visible vapor in a predetermined pattern to write messages in the sky and has a plurality of vapor generators attached to an airplane and spaced in a predetermined pattern. Each vapor generator has a burner which continuously burns, once ignited, until extinguished, and an oil injector which injects oil responsive to a remote control unit. The vapor generators are attached in a spaced relationship from a cable supported from a winch in the airplane and includes a second cable for spacing the generators as they are lowered from the plane.

22 Claims, 7 Drawing Figures

SKYWRITING APPARATUS

BACKGROUND OF THE INVENTION

The present invention relates to a skywriting apparatus and especially to a skywriting apparatus for simultaneously releasing a plurality of vapor streams or puffs in a predetermined pattern to form an aerial message with one pass of the airplane.

In the past, skywriting has been employed by a variety of means, including having vapor or smoke generators attached to a plane and have the plane fly a predetermined pattern as the pilot released smoke or vapor to form the message in the pattern that the pilot was flying. This method, however, required a substantial amount of flying time for the pilot in precision patterns to gradually put the letters together in smoke while releasing the smoke at only predetermined points. Typical devices for creating smoke in this manner may be seen in the Haddock, et al., U.S. Pat. No. 2,062,511. The smoke or vapor may be generated in a variety of ways including the injection of foil into the exhaust of the airplane for generating the vapor as illustrated in the Haddock patent, the injection of oil on a hot plate in an exhaust pipe section as illustrated in the Rankin U.S. Pat. No. 2,404,812; the production of smoke or fog in a burner such as in the Durr, et al., U.S. Pat. No. 3,244,641; and in a smoke generator such as in U.S. Pat. No. 3,632,067 and in the multiple smoke signal unit of U.S. Pat. No. 2,945,222. Signals are also generated by the use of chemicals such as titanium tetrachloride, which hydrolyzes upon coming into contact with the moisture in the air to form a white cloud such as shown in the Remey U.S. Pat. No. 2,065,024. There have been a number of suggestions for simplifying skywriting by avoiding the aerobatics required in forming the message along the pattern being flown by the airplane. These include the Hineman Pat. No. 1,503,830, for a skywriting device which releases bombs on a remote control pattern, which are ignited in a predetermined pattern to form the wording of the message. The Remey U.S. Pat. No. 2,065,024 and the Copeland U.S. Pat. No. 3,089,271, each teaches columns which extend from and below an air plane which may be released from the airplane on a winch and drawn back onto the winch. Each column has a pair of pipes formed therein and to which a plurality of spaced nozzles are connected so that the fluid from each column can be released from a remote command by actuating a nozzle to release the chemicals. Typically, titanium tetrachloride is used to produce a chemical smoke trail when released by a valve. The column in the Remey patent has stabilizer fins to stabilize the extended column below the plane. The Copeland patent also reaches a "piano roll" type control for controlling the release of the chemicals in a predetermined pattern, and includes the use of a winch along with controlling rollers and a guide drum for releasing and retracting the signal column and a terminating weight to help straighten the pipe line for generating the signal. The Remey patent on the other hand, does not provide for the extension and retraction of the column with the fins and nozzles protruding therefrom. In one prior U.S. Pat. No. 2,308,060, to DeRochefort-Lucay, a Means for producing Signs in Space, is provided which places a plurality of signal generators along the top of the airplane wing and controls the release of the smoke in a piano roll-type mechanism, actuating the valves in the order of the pattern on the attached roll.

The present invention advantageously provides for a long column to extend from the airplane supported from a standard winch cable while using a separate cable to space the vapor generator units. Each vapor generator is therefore attached to a steel cable and includes its own stabilizer tail and individual burner which can be ignited from the plane and an oil injection unit which is remotely controlled from the plane responsive to a remot control unit, the remote control unit provides for a quick change of messages which can be quickly produced on a film strip for writing the message in one pass of the airplane.

SUMMARY OF THE INVENTION

The present invention relates to a skywriting apparatus which is attached to an airplane and includes a plurality of vapor generator units attached in a spaced relationship to each other and supported by a winch attached cable to the airplane and by a spacing cable attached to the airplane. Thus, each vapor generating unit can be winched with a single winch pulling a single cable to retract or lower the vapor units which are then spaced apart, with each vapor unit having its own stabilizer, and each being an individual operative unit having a burner which is ignited from the airplane and an oil injector which is actuated by a remote control unit in the airplane to release vapor upon command from the control unit, to form a predetermined pattern of vapor in the atmosphere to write a message visible against the sky as a background. The cable for spacing the units has spacers located along its length to support each vapor generator thereon at its' predetermined position and the fuel oil and electrical lines are connected in a pattern so that the vapor units can be hoisted and stored under the plane in an orderly manner and lowered from the plane without an entanglement of the cables, fuel or oil lines. The remote control unit for actuating the vapor unit includes a film transport for moving the film having a message thereon, past a pick-up unit having at least one lamp placed adjacent the moving film and a plurality of fiber-optic fibers having one end positioned on the opposite side of the film from the lamp and extending to photodetectors to indicate when the light is being received through the film from the lamp. The photodetectors are, in turn, coupled to amplifiers which are coupled to each vapor generator for actuating the generator responsive to an amplified signal.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
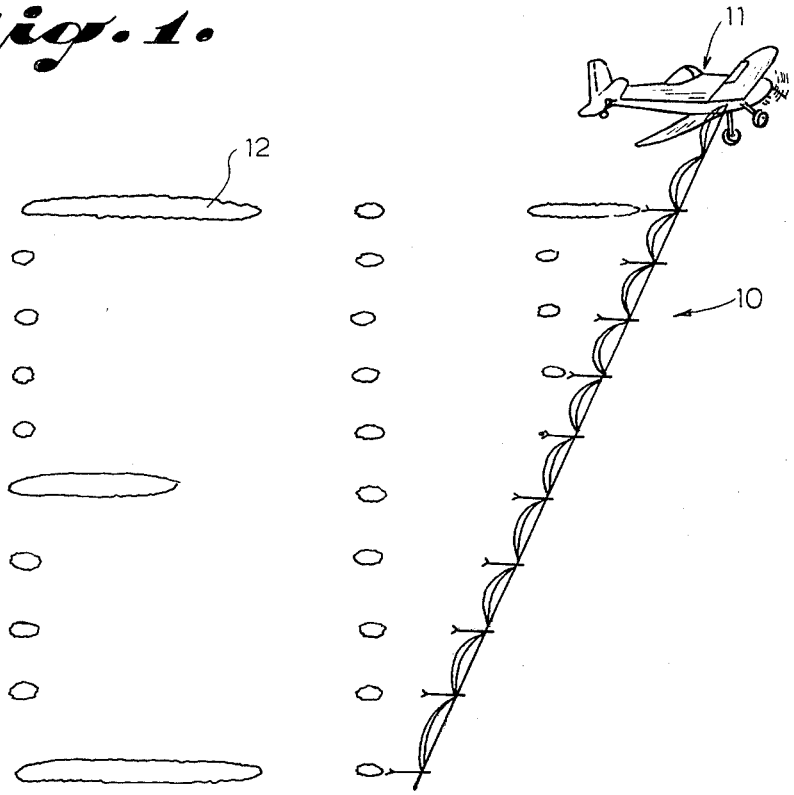
FIG. 1 is a perspective view of an airplane having the present skwriting apparatus attached thereto for writing a message in the atmosphere.
Figure 2:
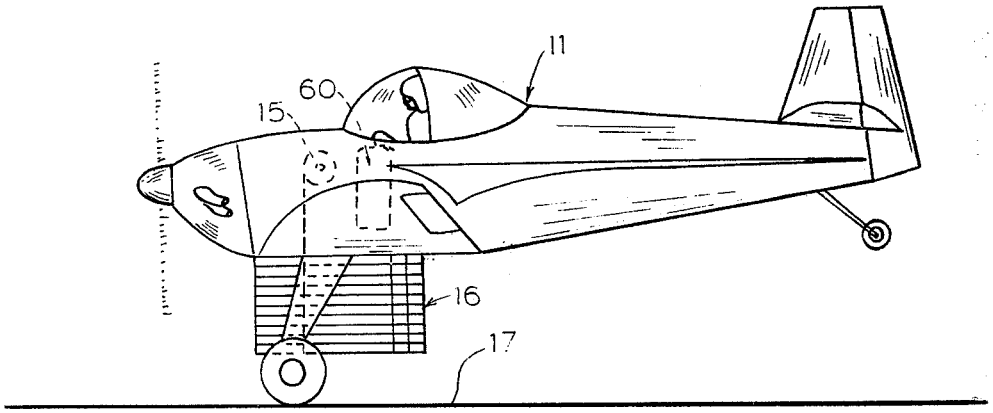
FIG. 2 is an elevational view of the airplane of FIG. 1 having the vapor units stored thereunder.
Figure 3:
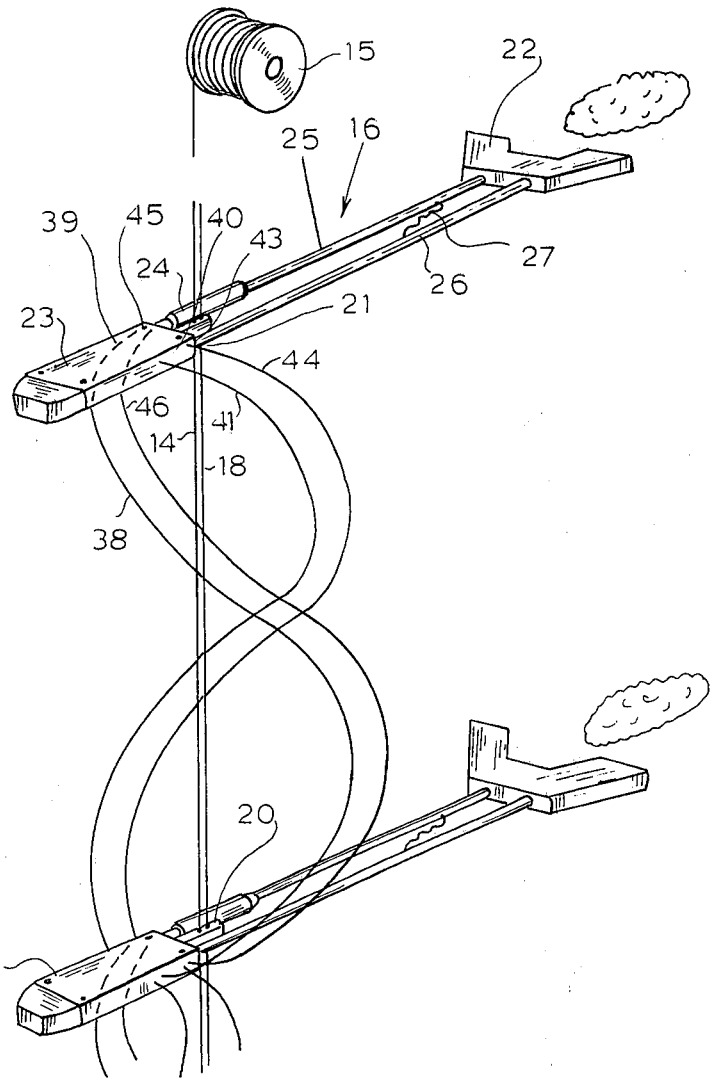
FIG. 3 is a perspective view of a pair of vapor generating units attached to the winch supporting cable.

Referring to the drawings in general and specifically to FIGS. 1 through 3, a skywriting apparatus 10 is illustrated attached to an airplane 11 and generating vapor trails 12 to write a message in the atmosphere. Skywriting unit 10 can be seen attached to an extending cable 14, supported by a winch 15 as illustrated in FIG. 3, which is located in the front portion of the airplane 11. The winch is controlled by the pilot to raise or lower the cable 14 to raise or lower a plurality of vapor generating units 16. The cable and vapor generating units are shown lowered in FIG. 1, and raised and stored beneath the airplane in FIG. 2, with the airplane in FIG. 2 located on a run-way 17. The winch 15 is a standard commercially available winch, having a heavy steel cable 14 attached thereto for rolling the cable 14 upon the spool of the winch 15. The winch is operated by a hydraulic motor (not illustrated). The vapor generating units 16 can also be seen attached to a spacing cable 18 with both cables 14 and 18 passing through a cable block 20. Steel cable 14 slides through the cable block 20 of each vapor generator 16 to wrap upon the spool 15 while pulling up the last of the extended vapor generating units 16 against the next to the last one, and so forth until all the units are pulled into a storage position as illustrated in FIG. 2, when the winch 15 lowers the cable 14, the vapor unit 16 extends until the cable block 20 engages spacer members 21 on the spacer cable 18 which supports each vapor unit 16 in a spaced relationship to each other vapor generator 16. The vapor generator unit 16 supplies the weight to extend the cables 14 and 18 below the airplane while each vapor generating unit 16 has a stabilizing tail 22 for stabilizing the generators when they are in the extended position on the cables. Each vapor generator has a nose portion 23 where most of the controls for the vapor generating unit 16 are located, along with a pulse jet engine burner 24, having an extended exhaust 25 connected to the stabilizer tail 22. A structural tube 26 also extends from the nose 23 to the stabilizer tail 22 and carries the vapor generating oil line 27 which is shaped to form a heat exchanger when passing from the structural tube 26 to the inside of the hot exhaust tube 25. The vapor trail is generated upon the injection of oil into the exhaust line 25. The serpentine shape of the oil line 27 passing between the structural tube 26 and the exhaust 25 keeps the oil cool until it is injected into the hot exhaust.

Figure 5:
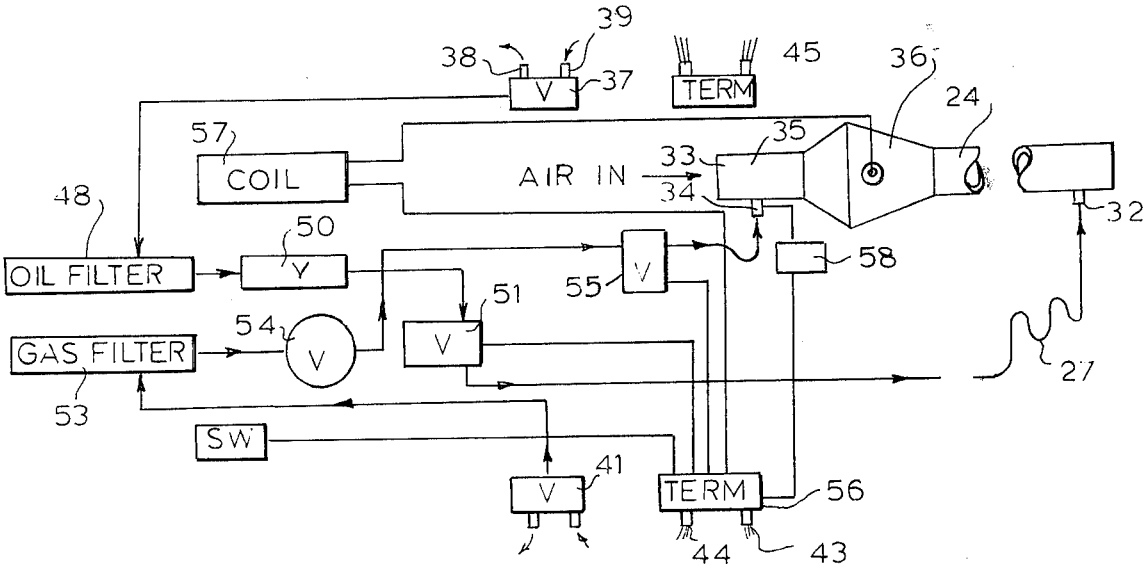
FIG. 5 is a block diagram of the operation of the vapor generating unit.
Figure 4:
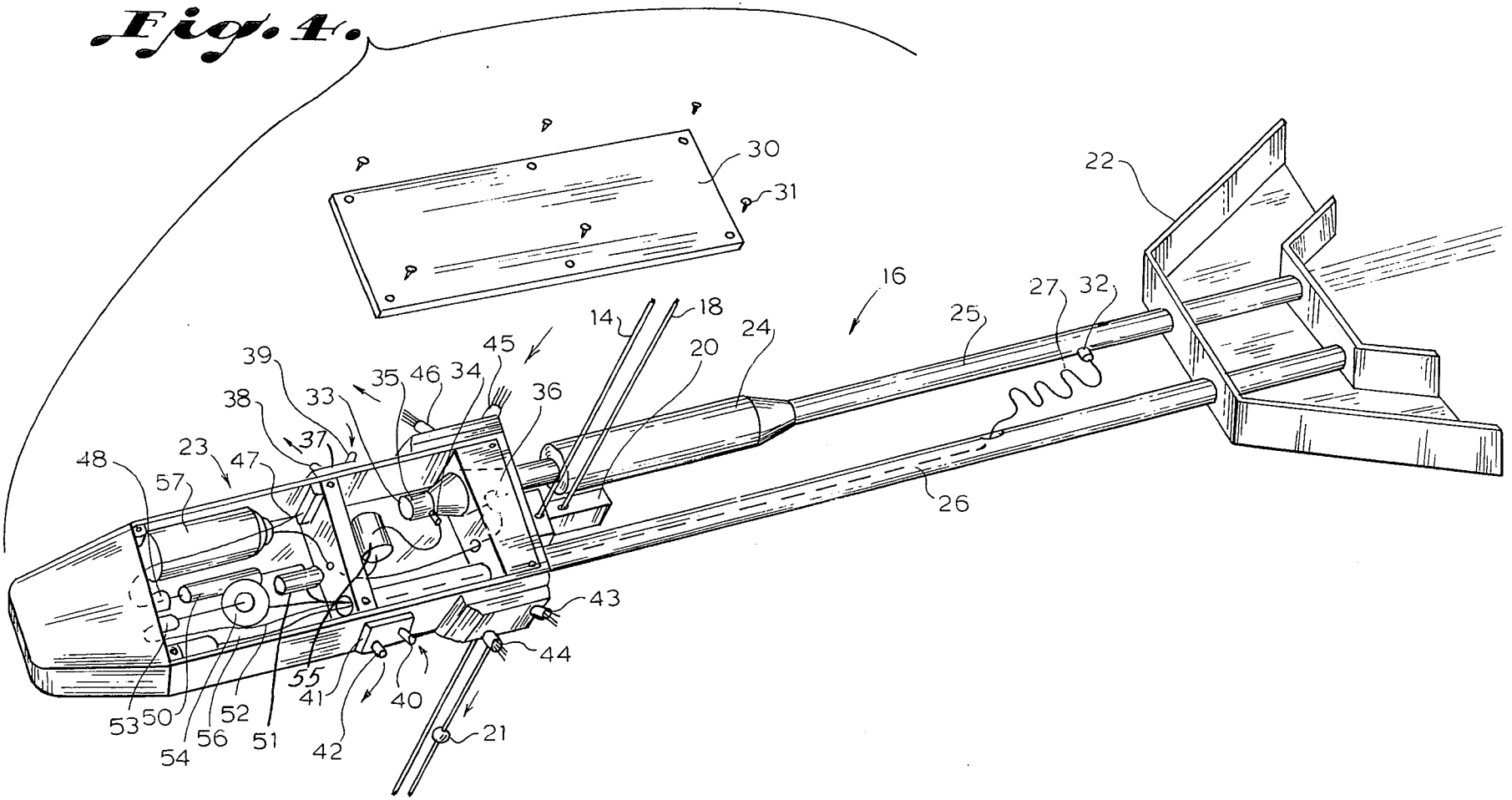
FIG. 4 is a perspective view of a vapor generating unit having the cover removed.

Turning now to FIGS. 4 and 5, the operation of each vapor generator 16 is more clearly illustrated having the nose portion 23 cover 30 removed therefrom which may be attached with a plurality of screws 31. The vapor unit in FIG. 4 is seen attached to the cable block 20 with cables 14 and 18 passing therethrough. Steel cable 14 is attached to the winch 15 of FIG. 3, while steel cable 18 has a plurality of spacers 21 attached thereto at predetermined locations, and is attached to the bottom portion of the airplane 11 of FIG. 1. The cable supporting block 20 is attached to the nose portion 23 of the vapor generating unit which has a structural tube 26 and an exhaust tube 25 connected to the pulse jet engine burner 24. The stabilizer tail 22 has the structural tube 26 and exhaust 25 extending therethrough while the oil injection line 27 can be seen connected to a nozzle 32 extending into the exhaust tube 25, where the oil is vaporized by the heat of the exhaust tube, and exhaust gas passing therethrough. The pulse jet 24 is operated by intake air from an intake nozzle 33 which has the air controlled by the intake under the cover 30 to prevent flameout by excessive air entering the nozzle 33 at higher speeds. The pulse jet engine is operated by the injection of fuel from a gas line 34 into a venturi portion 35 adjacent the intak 33. The air and gas mixture fed into the venturi portion 35 is ignited with a spark pulg 36 located downstream of the air and fuel intake to generate a flame in the burner portion 24 which then drives the hot exhaust and air through the exhaust pipe 25. Once the exhaust pipe becomes heated, the injection of oil through the oil line 27 and nozzle 32 generates the vapor. Each vapor generator 16 has an oil input line 39 entering an oil block 37 along with an oil output line 38 and a gas input line 40 entering a gas block 41 and has output line 42. Each unit also has a connection for input wire bundle 43 and a wire bundle 44 leaving the same side of the head portion 23 of the vapor generator 16. On the opposite side of the head 23 is a wire bundle 45 entering the head and wire bundle 46 leaving the head. The oil enters the oil line 39 passes through the oil line 47 to an oil filter 48, where the oil is filtered and passes through an oil flow rate valve 50 which regulates the flow of the oil passing therethrough. The oil then passes to an oil solenoid valve 51 having an electrical terminal 52 so that the solenoid can be turned on and off responsive to the controls in the plane for turning the oil on and off, for feeding the oil through the oil line 27 into the exhaust pipe 25. The gas, on the other hand, enters the gas input 40 of the gas block 41 and is directed by a pipe to the gas filter 53 where the gas is filtered and then fed to a gas pressure regulator 54 where the pressure of the gas is maintained to compensate for the different pressures the gas takes for the different vapor generators 16 from the gas pressure regulator 54. The gas is fed to a gas solenoid valve 55 which turns the gas on and off responsive to controls in the airplane, and from which the gas is fed through line 34 and injected into the venturi portion 35 of the pulse jet burner. An electrical terminal block 56 allows the electrical connections to be connected to the different solenoid valves for actuating them upon command and a spark coil 57 generates the necessary spark for actuating the spark plug 36 for starting the vapor units. It should also be realized that the oil block 37 and the gas block 41 each have valves for allowing the flow of oil and gas to the head portion 23 of each vapor generator unit and to control the continued flow through the output pipe for the next lower vapor generating unit as set forth in the block diagram in FIG. 5. A delay circuit control 58 as shown in FIG. 5 and also illustrated in FIG. 7, provides an electromagnetic switch 59 mounted adjacent a delayed timing circuit 61 which, in turn, has a spring-actuated rotary timing member 62 driving a pin 63 which extends into the carburetor intake jet 64 to vary the gas feed therethrough to adjust the airfuel ratio when first starting the burners 24.

Thus, in operation, as shown by the vapor generator in FIG. 4, the cables entering 45 and leaving 46 are merely passed on to the next generator while the even numbered cables 43 form all the connections for the vapor generator. A line from the cockpit of the airplane is used to actuate the burners 24 by generating the spark of the spark plug while actuating the gas solenoid valve 55 to start the burner which burns continuously and once the exhaust pipe 25 is fully heated, the oil for generating the vapor may be injected into the pipe through the nozzle 32 by actuating the oil solenoid valve 51 which is actuated from a remote control unit in the airplane which clearly is illustrated in connection with FIG. 6. The control in the plane includes an electrical switch coupled to each vapor generator by an electrical conductor for actuating all of the vapor generator burners at once.

Figures 6, 7:
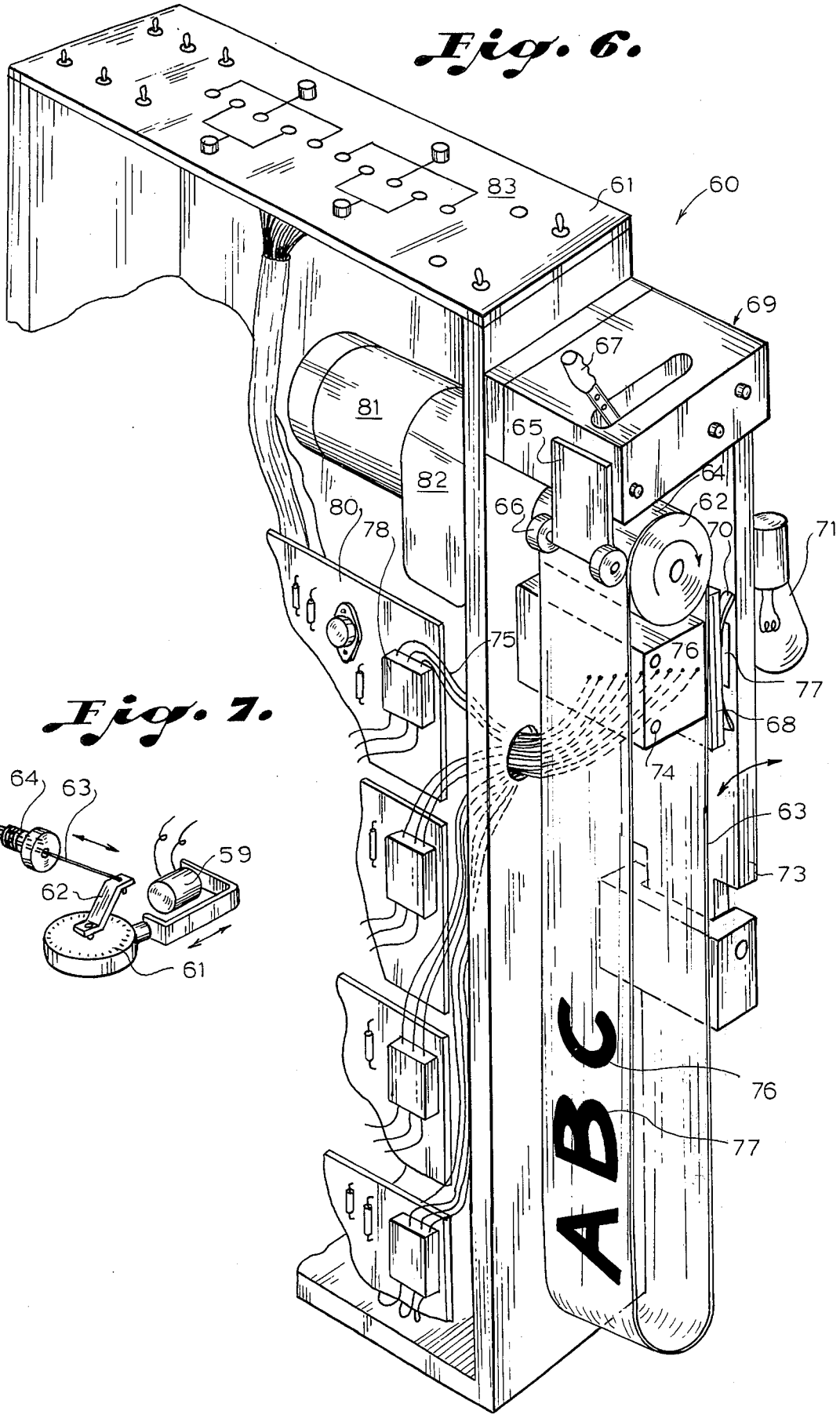
FIG. 6 is a cut-away perspective view of the control unit of the present invention.
FIG. 7 is a perspective view of the burner unit fuel intake jet control.

In FIG. 6, a remote control unit 60 is mounted in a casing 61 and includes a film transport drum 62 in which an endless loop of 35mm film 63 may be pulled by the transport drum 62 having rubber friction bands 64 thereon. A spring pressure plate 65 has a pair of pressure rollers 66 attached therethrough which may be pushed out of the way by the lever arm 67 for placing a new strip of film 63 on the transport identified generally as 69. The film is held in position by the pick-up portion by a pressure plate 68 and spring-loaded by leaf springs 70, Adjacent the transport 62 is a lamp 71 which can be a conventional or electrical lamp or may be a row of LEDs (Light Emitting Diodes) as desired, which produces light through window 72 in a frame member 73. A fiber optic pick-up head block 74 is placed between the endless film strip 63 and has a plurality of optical fibers 75 feeding therein, and having their tips 76 at predetermined positions facing the lamp 71 on the opposite side of the film 63. Numerals which may be black numerals 76 on a transparent film base 77 or which could, of course, be clear numerals on a black film base, if desired, are fed by the transport 62 through the pick-up head portion. The lamp 71 shining through film 63 reads the letters 76 thereby either generating or turning off the signals to the fibers 75. Each of the fibers feeds light signals to a photodector 78 located at the opposite tip of each fiber 74 from the tip 76. The photodector then generates a small electrical signal which is amplified by an amplifier 80 and the amplified signal for each portion of each letter 76 is fed through either the umbilical cord 43 or 45 to the appropriate vapor generator 16 to thereby actuate one of the oil solenoid valves 51 responsive to the signal from the amplifier 80. An electric motor 81 drives the transport drum 61 to actuate the unit through the gear box 82 at a predetermined speed and a control panel 83 has a plurality of switches which may be utilized to switch on the motor 81 along with the amplifiers 80, the lamp 71, the photodector 78, and for starting the vapor units, if desired. The film strip 63 may advantageously be made by contact printing predetermined leters onto standard 35mm film, and processing to produce a transparent tape having black letters thereon, and the tape spliced together to form an endless loop. The pilot may then carry a number of loops with him and by simply shifting the lever 67, remove the film 63 from the drive drum 62, then insert another endless loop. By having an endless loop, the message may be repeated over and over as many times as the pilot desires without removing the film 63. It will, of course, be clear that other types of films or ribbons can be utilized in the transport and that the ribbons do not have to be of an endless loop type without departing from the spirit and scope of the invention. The control unit 60 would normally be mounted in the airplane to one side of the pilot so that it can be easily operated by a pilot while flying the airplane.

It should be clear at this point that a skywriting system has been provided which can be easily operated by a single pilot flying a plane without performing aerobatics and from a central control system within the cockpit of the airplane; however, it should also be clear that the invention is not intended to be limited to the specific forms disclosed herein which are to be considered illustrative rather than restrictive.

In the Claims: I claim:

1. A skywriting apparatus comprising in combination:
an airplane;
a winch attached to said airplane;
a support cable supported from said winch and adapted to be lifted by said winch and to be lowered by said winch;
a plurality of vapor generating units for generating visible vapor on command;
each said vapor generating unit being attached to said support cable in a spaced relationship to each other once the cable is extended and to be drawn together when such cable is raised; and
a spacer cable operatively connecting each said vapor generator together at predetermined spaced positions along said spacer cable and support cable whereby said support cable can raise and lower said vapor generators and said spacer cable can maintain the vapor generator spaced when said support cable is lowered.

2. The skywriting apparatus in accordance with claim 1, in which said spacer cable has a plurality of spacers thereon for holding said vapor generators at predetermined positions when said cable is lowered.

3. The apparatus in accordance with claim 2, in which said vapor generators each have a guide block thereon with said support cable passing therethrough and being slidably supported thereby.

4. The apparatus in accordance with claim 3, in which said spacer cable passes through an opening in said guide block and is slidably supported by said guide block, said guide block abutting against said spacers on said spacer cable when said support cable is extended.

5. A skywriting apparatus comprising in combination:
an airplane;
a plurality of vapor generators attached to said airplane in a spaced relationship to each other;
control means for controlling the release of vapor from said vapor generators, said control means having a film transport mechanism for driving film having a message thereon in a predetermined path, a lamp located adjacent said film transport on one side of a strip of film located therein;
a plurality of fiber optic fibers having one end thereof located adjacent said film transport on the opposite side of a piece of film located therein;
a plurality of photodetectors located adjacent the other end of said fiber optic fibers whereby signals are communicated from said film as said film is driven by the transport;
amplifier means coupled to each said photodector to amplify signals generated by said photodetectors; and
vapor generator vapor actuating means coupled to said amplifier to actuate said vapor generators to release vapor in predetermined patterns responsive to signals from said film.

6. The skywriting apparatus in accordance with claim 5, in which said fiber optic fibers one end is mounted in a block of material to position said fibers in predetermined position adjacent film located in said film transport.

7. The apparatus in accordance with claim 6, in which said amplifier means is coupled to said vapor generator vapor actuation means includes solenoid valves actuated by said electrical signals.

8. The skywriting apparatus in accordance with claim 7, in which said film transport is a 35mm spool for driving an endless loop of film therepast.

9. The skywriting apparatus in accordance with claim 8, in which said control means is locted in the airplane cockpit adjacent the pilot's seat, whereby the pilto can actuate the skywriting apparatus.

10. The skywriting apparatus in accordance with claim 9, in which said control means includes an electrical switch coupled to each vapor generator by an electrical conductor for actuating all said vapor generator burners at once.

11. The skywriting apparatus in accordance with claim 10, in which said ignition control actuates an electrical solenoid valve for feeding gas to said vapor generator and simultaneously applying a sprak through a spark plug for ingiting said burner.

12. The apparatus; in accordance with claim 11, in which said ignition includes an intake jet for feeding gas to said burner, said intake jet having delay means for varying fuel feed to the burner upon ignition.

13. A skywriting vapor generator apparatus comprising in combination:

a burner having a solenoid-actuated fuel nozzle therein and a spark ignition for igniting saif fuel and an exhaust pipe connected to said burner;

an oil injection having a solenoid actuated nozzle and being operatively connected to said burner exhaust pipe for discharging a vapor generating oil thereinto responsive to actuating said solenoid;

control means being operatively connected to said burner for igniting said burner, and being operatively connected to said oil injector for actuating said oil injector responsive to said electrical signals from said control means; and said skywriting vapor generator aving stabilizer means attached thereto for stabilizing said vapor generator as it moves through the atmosphere.

14. The apparatus in accordance with claim 13, in which said vapor generator unit has a head portion having said oil injector and solenoid-actuated fuel nozzle and spark ignition mounted therein, a burner unit and an exhaust extending from said head unit and a structural tube extending parallel to said exhaust, and a stabilizer tail mounted to said structural tube and said exhaust.

15. The apparatus in accordance with claim 14, in which said structural tube had said oil injection lines passing therethrough and extending therefrom to said exhaust lines for injecting vapor generating oil into said exhaust line.

16. The apparatus in accordance with claim 15, in which said oil injection line forms a heat exchanger between said structural tube and said exhaust line for cooling said oil being fed to said exhaust line.

17. The apparatus in accordance with claim 16, in which said oil is fed to said vapor generator units from a supply tank on said airplane and has a valve connection controlling the flow from said vapor generator unit to an adjacent vapor generator unit.

18. The apparatus in accordance with claim 17, in which said fuel for said vapor generator unit is fed to said vapor generator unit from a supply tank in said airplane and is connected by a pass-through block in said vapor generator unit to a line leading to an adjacent vapor generator unit, whereby a series of vapor generating units may be mounted parallel and receive fuel through a series connected line.

19. The apparatus in accordance with claim 18, in which said oil is fed from said oil line into said vapor generating unit through an oil filter and oil flow rate valve through an oil solenoid valve.

20. The apparatus in accordance with claim 19, in which said burner fuel is fed from said fuel input line to said vapor generator through a gas filter into a gas pressure regulator and then to said gas solenoid valve whereby fuel fed to said burners is filtered and maintains a predetermined pressure by said pressure regulator.

21. The apparatus in accordance with claim 20, in which said vapor generating unit has a cable block mounted thereto having two openings therethrough for passage of support cables for supporting said vapor units from an airplane, one said cable having means for supporting said vapor generating units at a predetermined position on said cables.

22. The apparatus in accordance with claim 21, in which said second cable is attached to a winch located in said airplane and attached to one vapor unit for lifting said one vapor unit until it reaches the next vapor unit and then lifting both vapor units until it reaches the next vapor unit and all said vapor units have been pulled adjacent said airplane.

* * * * *